US009989285B2

(12) United States Patent
Fountain et al.

(10) Patent No.: US 9,989,285 B2
(45) Date of Patent: Jun. 5, 2018

(54) PURGING APPARATUS

(71) Applicants: John H Fountain, Hoschton, GA (US); Jeffrey K Welch, Ponte Vedra Beach, FL (US)

(72) Inventors: John H Fountain, Hoschton, GA (US); Jeffrey K Welch, Ponte Vedra Beach, FL (US)

( * ) Notice: Subject to any disclaimer, the term of this patent is extended or adjusted under 35 U.S.C. 154(b) by 513 days.

(21) Appl. No.: 14/449,128

(22) Filed: Jul. 31, 2014

(65) Prior Publication Data

US 2016/0033184 A1 Feb. 4, 2016

(51) Int. Cl.
*F25B 45/00* (2006.01)
*F25B 43/04* (2006.01)

(52) U.S. Cl.
CPC ..... *F25B 43/043* (2013.01); *F25B 43/04* (2013.01); *F25B 2400/053* (2013.01)

(58) Field of Classification Search
CPC ..... F25B 43/043; F25B 43/04; F25B 39/04; F24F 2400/053
USPC ..... 165/DIG. 207
See application file for complete search history.

(56) References Cited

U.S. PATENT DOCUMENTS 1,721,261 A * 7/1929 Smith ..... F28B 1/02 165/114
2,598,799 A 6/1952 Kiene
2,920,458 A 1/1960 Watkins
RE24,802 E * 3/1960 Kocher et al. ..... F25B 31/006 310/54
3,145,544 A 8/1964 Weller
3,592,017 A 7/1971 Lipman
3,935,715 A * 2/1976 Newton ..... F25B 39/04 165/111
5,088,291 A 2/1992 Squires
5,291,743 A 3/1994 Van Steenburgh, Jr.
5,388,416 A 2/1995 Manz
5,582,023 A 12/1996 O'Neal
5,592,826 A 1/1997 Sagar
5,921,097 A 7/1999 Galbreath, Sr.
6,647,736 B2 11/2003 Heiden

* cited by examiner

*Primary Examiner* — Orlando E Aviles Bosques
(74) *Attorney, Agent, or Firm* — Smith Tempel Blaha LLC; Gregory Scott Smith

(57) ABSTRACT

A purging apparatus for removing a non-condensable gas from a refrigeration system is described and which includes a low temperature liquid refrigerant storage tank for enclosing refrigerant, which is supplied by the refrigeration system, and a condenser having a main body, which lies in conductive heat transferring relation relative to an exterior facing surface of the storage tank and progressively to the low temperature liquid refrigerant within, and wherein the condenser, is maintained at a reduced temperature by the low temperature liquid refrigerant enclosed within the storage tank, and wherein foul gas generated by the refrigeration system is processed by the condenser in a manner so as to remove non-condensed refrigerant, and return the condensed refrigerant to the storage tank while releasing non-condensable gases to the ambient environment.

12 Claims, 7 Drawing Sheets

PURGING APPARATUS

TECHNICAL FIELD

The present disclosure relates to a purging apparatus for a refrigeration system, and more specifically to a purging apparatus which is passively chilled or reduced in temperature due to being associated with a low temperature refrigerant storage vessel, and which is further arranged to provide a convenient means for removing non-condensable gases that may have accumulated within the refrigeration system.

BACKGROUND OF THE INVENTION

In refrigeration systems of various designs, a refrigeration medium (refrigerant) is typically utilized. For instance, some systems may utilize a refrigerant such as liquid ammonia as a non-limiting example. In the use of such refrigerants, certain foul or foreign gases, such as ambient air, and the like, find their way into, and accumulate within such systems after a period of use and through a variety of manners. For instance, opening the system to conduct maintenance or repairs may result in such contamination of the system. The collection of these foul gases considerably reduces the cooling capacity of the refrigeration system, over time, and it has long been known that it is desirable to purge such non-condensable gases from a refrigeration system to maximize the cooling efficiency of the same.

Various purging arrangements and systems have been suggested and taught in various prior art references, and have been used, to some degree, to eliminate these non-condensable gases.

Notwithstanding the prior art practices and devices utilized, heretofore, to purge these undesirable, non-condensable gases from a refrigeration system, the results that have been achieved have not entirely been satisfactory. Furthermore, depending upon the nature of the refrigeration system and the extent of its utilization, purging may have to occur on a rather regular and/or frequent cycle. Often the time periods between these purging cycles may vary based upon the refrigeration load experienced by the refrigeration system. Therefore, while existing purging systems have operated with some degree of success, numerous shortcomings have resulted from their continued practice, and designers of such refrigeration systems have searched for improved means by which purging may be accomplished with further less complicated means than what have been proposed heretofore, and which further can be reliably conducted on a periodic basis and in a manner not possible utilizing the devices which have been employed and described in the art for decades.

A purging apparatus, for use with a refrigeration system, that is useful in removing non-condensable gases from a refrigeration system is the subject matter of the present disclosure.

SUMMARY

A first aspect of an exemplary embodiment of a purging apparatus operates to remove a non-condensable gas from a refrigeration system. The various embodiments operate in conjunction with a storage tank or vessel integrated into and operating within the refrigeration system. As those skilled in the art will appreciate, the vessel of a refrigeration system houses a source of refrigerant, such as a low temperature liquid refrigerant as a non-limiting example. The vessel, housing the low temperature liquid, is typically insulated and thus, the interior of the vessel, as well as the exterior surfaces of the vessel are maintained at a low ambient temperature. In general, the low ambient temperature characteristics of the vessel are exploited in embodiments of the purging apparatus to cool, such as by operating as a heat sink, cooling the purging apparatus and thus enabling the purging apparatus to separate refrigerant from non-condensable gases within the purging device. Thus, the various embodiments of the purging device can be associated with the vessel by securement of the purging device to an exterior facing surface of the vessel, which is maintained at a low ambient temperature by a compressor which reduces and controls the pressure of the refrigerant that is enclosed within the vessel. Thus, in such embodiments, the purging device may include a condenser that has a main body which lies in conductive, heat transferring relation relative to the exterior facing surface of the vessel. However, in other embodiments, the purging vessel may be directly cooled by the liquid refrigerant within the vessel by being mounted to an interior surface or otherwise being mounted within the interior of the vessel. Thus, in some exemplary embodiments, the main body of the purging apparatus is passively maintained at a low ambient temperature by the exterior facing surface of the storage container, which is in turn cooled by the liquid refrigerant within the vessel. However, in other embodiments, the purging apparatus is maintained at a low ambient temperature by the surround liquid refrigerant.

In general, the purging apparatus operates similar to a condenser. For instance, in some embodiments the purging apparatus includes a plurality of vertically oriented internal passageways or tubes in which a foul gas is inserted into the tubes will cool and condense thereby allowing liquid refrigerant to drop towards the bottom while the non-condensable gas rises to the top. The purging apparatus further includes a foul gas inlet; a condensed refrigerant outlet; and a non-condensable gas outlet. A source of a foul gas, which may include both a non-condensed refrigerant and a non-condensable gas, is received from the refrigeration system, and is directed into the purging apparatus. Within the purging apparatus, the foul gas is exposed to the low ambient temperature and is thus reduced in temperature to facilitate a condensation of the previously non-condensed refrigerant from the source of foul gas. As such, the condensed refrigerant collects within a plurality of vertically oriented passageways in appropriate embodiments of the purging apparatus and, the condensed refrigerant can then exit the purging apparatus by way of the condensed refrigerant outlet. The condensed refrigerant is thus returned to the vessel for continued operation. On the other hand, the non-condensable gas is expelled from the purging device by way of the non-condensable gas outlet and is released to an ambient environment either directly or through a scrubber or some other mechanism.

In some embodiments, the purging device is utilized in conjunction with a vessel that is defined, and least in part, by a sidewall having an exterior facing surface which has a given curvature. Similar to the previous embodiment, the exterior facing surface of the sidewall is maintained at a low ambient temperature by the liquid refrigerant enclosed within the vessel. The purging apparatus includes a main body fabricated, at least in part, of aluminum, and is further defined by an exterior facing surface which matingly conforms, at least in part, with the exterior facing surface of the vessel. Thus, the exterior facing surface of the purging apparatus is located, at least in part, in heat transferring relation relative to the exterior facing surface of the vessel.

As a result, the main body of the purging apparatus is passively maintained at a low ambient temperature by the vessel operating as a heat sink. The purging apparatus includes an interior that comprises a multiplicity of vertically oriented internal passageways which extend between a first, and an opposite, second end of the main body. The interior of the purging device is coupled in fluid flowing relation to a condensed refrigerant outlet located on the first end of the main body. In addition, a non-condensable gas outlet located on the second end of the main body is also in fluid communication with the interior of the purging device. A foul-gas inlet located on the main body is positioned between the first and second ends of the main body. The condensed refrigerant outlet is coupled in fluid delivering relation relative to the vessel and thus, condensed refrigerant can be returned to the refrigerator system through this outlet. The non-condensable gas outlet is coupled in fluid delivering relation relative to a surrounding ambient environment, a scrubber or some other filter or storage mechanism thus allowing the non-condensable gas to be ejected from the refrigeration system. The foul gas inlet is coupled in fluid receiving relation relative to the source of the foul gas, which has entered the refrigeration system and is generally collected or recovered within a condenser operating within the refrigeration system. A variety of selectively controllable fluid flowing valves are utilized for individually controlling the respective delivery of the condensed refrigerant from the condensed refrigerant outlet; the release of a non-condensable gas from the non-condensable gas outlet; and the delivery of the source of the foul gas to the foul gas inlet. Further, a controller is utilized for selectively controlling the operation of the selectively controllable fluid flowing valves so as to facilitate a purging of the non-condensable gas from the source of the foul gas from the refrigeration system, and the delivery of the condensed refrigerant to the storage tank.

These and other aspects, features and various embodiments are discussed in greater detail hereinafter.

BRIEF DESCRIPTION OF THE DRAWINGS

Preferred embodiments of the invention are described below with reference to the following accompanying drawings.

DETAILED DESCRIPTION OF THE VARIOUS EMBODIMENTS

Now turning to the figures in which like reference indicators refer to like elements in the various views, further features, aspects and elements that may be incorporated into the various embodiments of the purging device are further described. The various embodiments, as well as features and aspects of the purging apparatus is generally indicated by the numeral 10 in the figures.

Figure 1:
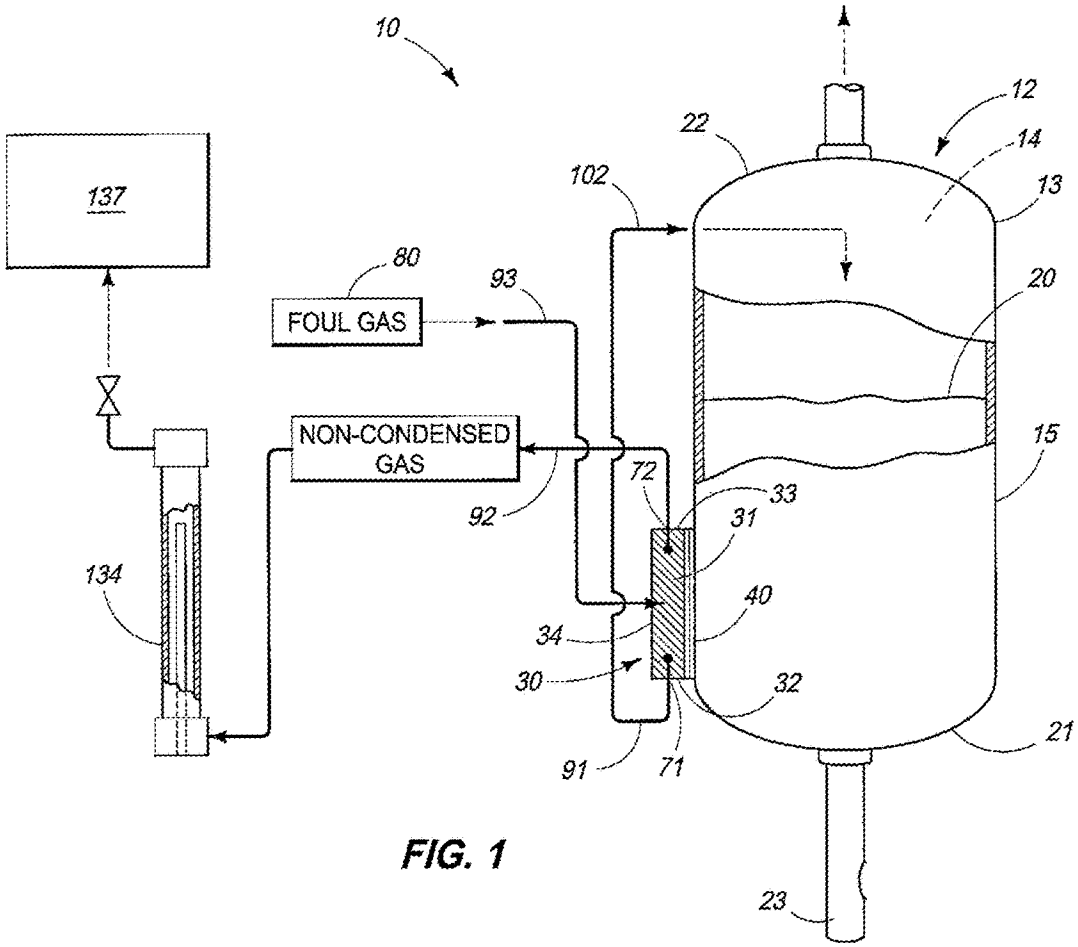
FIG. 1 is a block diagram illustrating an exemplary environment of relevant elements of a refrigeration system in which exemplary embodiments of the purging apparatus may operate.
Figure 5:
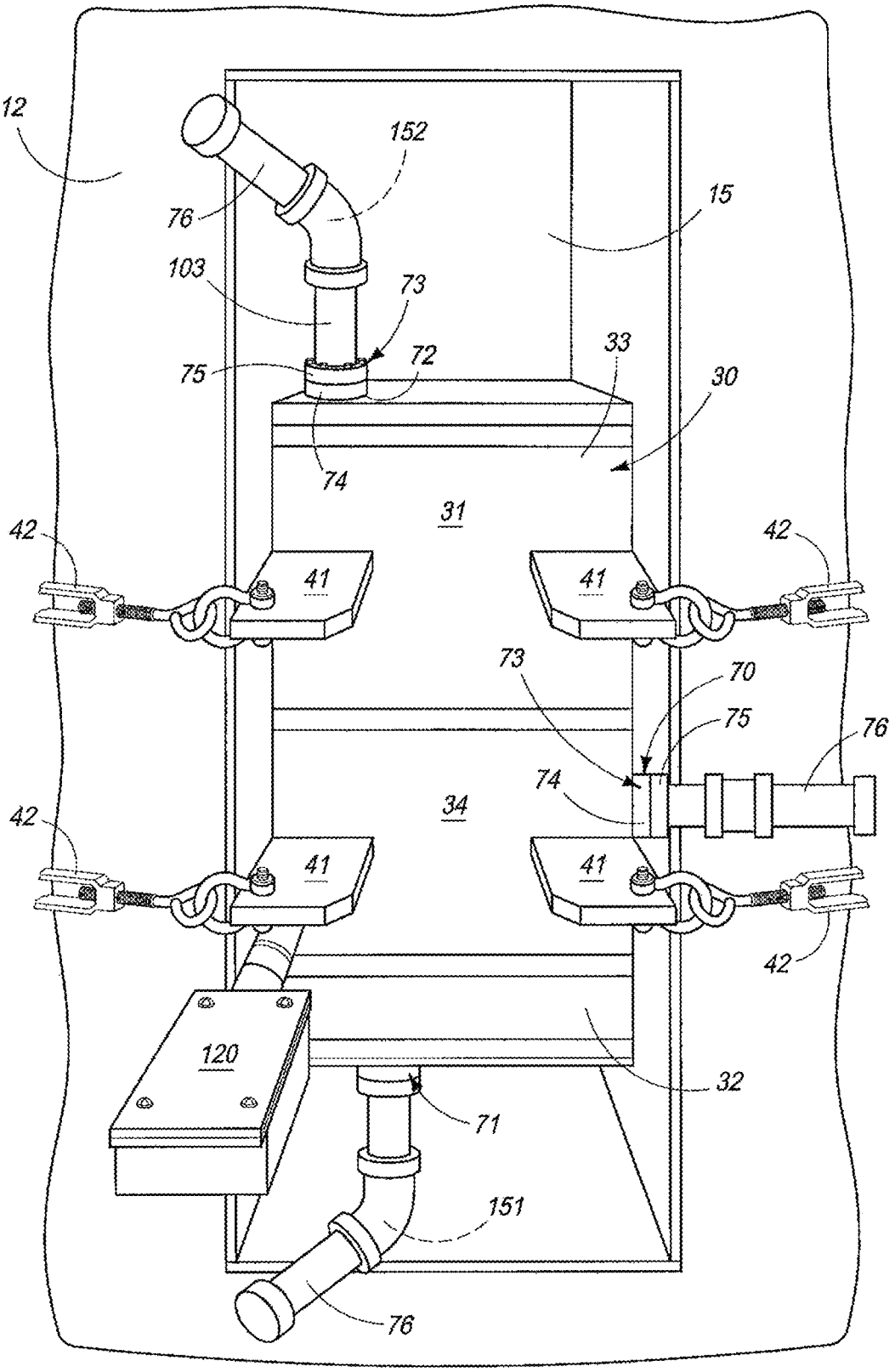
FIG. 5 depicts an exemplary purging apparatus positioned in heat transferring relation relative to an underlying vessel.

FIG. 1 is a block diagram illustrating an exemplary environment of relevant elements of a refrigeration system in which exemplary embodiments of the purging apparatus may operate. The refrigeration system environment 10 is illustrated as including the purging apparatus 30. The purging apparatus 30 is configured to remove non-condensable gases that periodically collect within an existing refrigeration system 10. These non-condensable gases typically include air and other gases. The refrigeration system 10, as generally indicated in FIG. 1, includes a storage tank or vessel 12. The illustrated vessel 12 is defined by a continuous sidewall 13 defining an interior cavity 14. The vessel 12 further has an exterior facing surface 15, as seen in FIG. 5. The exterior facing surface typically has a predetermined curvature but it should be appreciated that in various embodiments, the purging device may be adapted to any of a wide variety of shapes and sizes of vessels. As seen in FIG. 1, the vessel 12 is operable to receive and store a source of a liquid refrigerant 20. The liquid refrigerant, as employed in the illustrated refrigeration system 10 can be any of a variety of refrigerants, such as liquid ammonia as a non-limiting example. The vessel 12 has a first end 21, and an opposite second end 22. A refrigerant delivery conduit 23 is coupled to the first end 21 and is operable to deliver refrigerant to other components of the refrigeration system.

Figure 3:
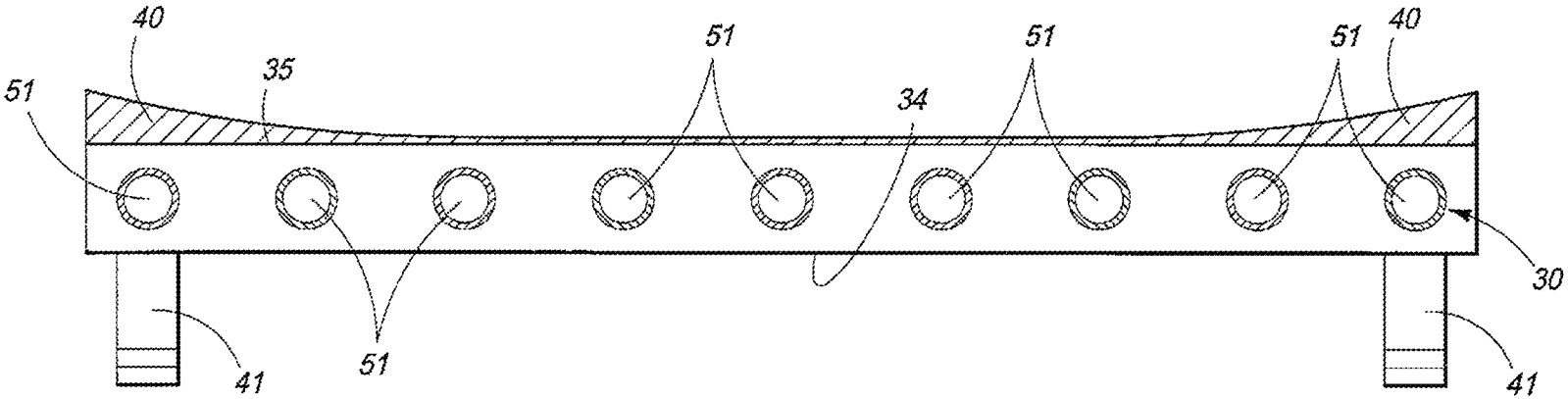
FIG. 3 is a transverse vertical sectional view taken from a position along line 3-3 of FIG. 2.

The illustrated purging apparatus 30 in a general sense, operates as a condenser and is generally identified in the figures by the numeral 30, as seen in FIG. 1 and following. The purging apparatus 30 can be fabricated from aluminum as a non-limiting example but, can also be fabricated from a similar high heat transfer material in embodiments that are external to the vessel 12 but, could be manufactured utilizing other materials for internal embodiments. The illustrated purging apparatus 30 has a generally narrowly rectangular shaped main body 31, as best seen by reference to FIG. 5. The main body 31 has a first end 32, and an opposite second end 33. Still further, the main body 31 has a forward or exterior facing surface 34, and an opposite, rearwardly facing surface 35 (FIG. 3). In the arrangement as seen in the drawings, a heat conducting boundary portion 40, is provided and which conformably mates to the curved exterior facing surface 15 of the vessel 12, and is operable to couple the main body 31 of the purging apparatus 30 in heat transferring relation relative to the exterior facing surface 15 of the vessel 12. It should be understood that the liquid refrigerant 20 within the vessel 12 is operable to maintain the exterior facing surface 15 at a reduced temperature. This reduced temperature of the exterior facing surface 15 is effective in cooling or chilling the main body 31 of the purging apparatus 30, in a passive manner, so as to facilitate the condensation of a condensable refrigerant from a foul gas source, as will be described in greater detail, below.

Figure 2:
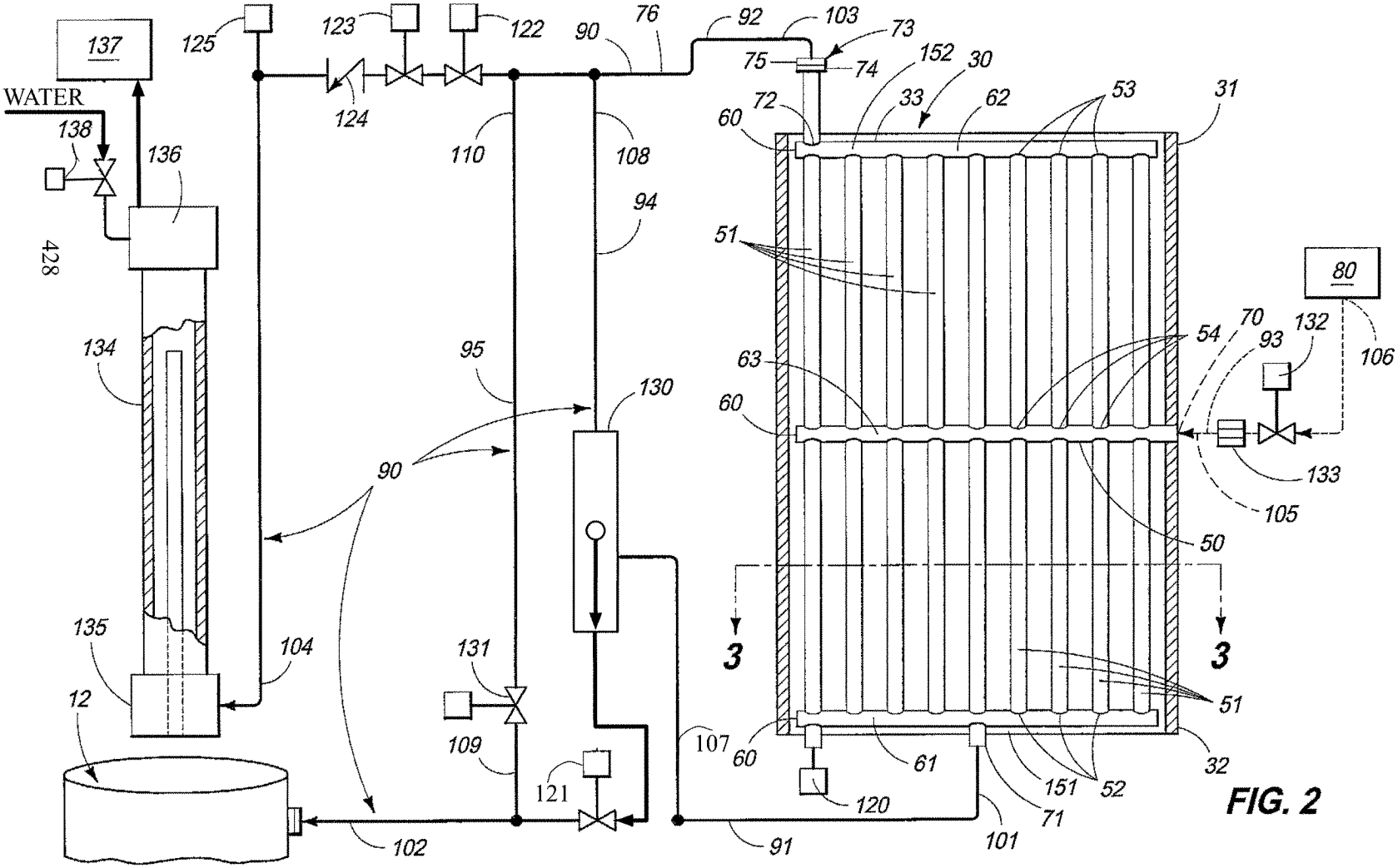
FIG. 2 is a schematic, greatly enhanced view of the purging apparatus, as illustrated in FIG. 1, and which graphically depicts the arrangement of the purging apparatus, in combination with various fluid flowing control valves.

FIG. 2 is a schematic, greatly enhanced view of the purging apparatus, as illustrated in FIG. 1, and which graphically depicts the arrangement of the purging apparatus, in combination with various fluid flowing control valves. The main body 31 of the purging apparatus 30 has an internal cavity 50 (FIG. 2), which is defined, in part, by a plurality of vertically oriented internal passageways 51, which have a cross-sectional dimension of approximately 0.75 inches as a non-limiting example. Each of the vertically oriented internal passageways 51 has a first end 52, and an opposite second end 53. Further each of the internal passageways 51 has an intermediate portion 54. The respective vertically oriented internal passageways are each coupled together in fluid flowing relation, as will be described in further detail, below thus creating a single cavity 50.

FIG. 5 depicts an exemplary purging apparatus positioned in heat transferring relation relative to an underlying vessel. As seen in FIG. 5, the purging apparatus 30 includes a plurality of outwardly extending engagement members 41 mounted on the main body 31. Further, several attachment or engagement cables 42 are provided which circumscribe the vessel 12, and secure the main body 31 in an appropriate heat transferring relationship relative to the chilled vessel 12. The engagement cables are individually affixed to the respective engagement members 41.

Returning to FIG. 2, the internal cavity 50 of the purging apparatus 30 is further defined, at least in part, by a plurality of transversely disposed passageways 60. These passageways include first, second and third transversely disposed passageways 61, 62 and 63, respectively, as seen in the drawings. The respective first, second and third transversely disposed passageways couple the plurality of vertically oriented internal passageways 51 in fluid flowing relation, one relative to the others. In operation, and as will be discussed in greater detail hereinafter, the arrangement of the passageways 60 facilitate, in part, the condensation of the non-condensed refrigerant from a source of foul gas 80, as will be described, hereinafter, and further directs the condensed refrigerant, and any remaining non-condensable gases, along the plurality of vertically oriented internal passageways 51 so that the respective fluids (refrigerant or non-condensed gas) may appropriately exit the condenser 30 in the manner which will be set forth, below in greater detail.

In the arrangement as seen in the drawings, the purging apparatus 30 includes a foul gas inlet 70; a condensed refrigerant outlet 71, and a non-condensable gas outlet 72. Each of these inlets/outlets are formed in, or otherwise made integral with the main body 31 of the condenser 30. In this regard, the respective inlets/outlets 70, 71 and 72 may each include a dielectric fluid coupler, which is generally indicated by the numeral 73. As a non-limiting example, the dielectric fluid coupler 73 can be fabricated in a fashion so as to have a first aluminum portion 74, which engages or is otherwise matingly coupled or secured to the respective foul gas inlet; condensed refrigerant outlet; or non-condensable gas outlet respectively; and a second portion 75, which maybe fabricated of a carbon steel. The second portion 75 is operable to be coupled to and threadably mate with, an accompanying steel conduit 76 of traditional design (FIG. 5). In the arrangement, as seen in the drawings, the condensed refrigerant outlet 71 is positioned at the first end 32 of the main body 31, and is further located in fluid flowing relation relative to the first transversely disposed passageway 61 (FIG. 2). The condensed refrigerant outlet 71 is operable to receive condensed refrigerant, which is derived, in part, from a source of foul gas 80, which enters the purging apparatus. In contrast, the non-condensable gas outlet 72 is located at the second end 33 of the main body 31. The non-condensable gas outlet 72 is coupled in fluid flowing relation relative to the second transversely disposed passageway 62 (FIG. 2), and is further operable to output non-condensable gas derived from the source of foul gas 80 which is delivered to the main body 31. In addition to the foregoing, the foul gas inlet 70 is made integral with, or is defined by, the main body 31 of the purging apparatus 30, and which is positioned on the main body 31 intermediate the first and second ends 32 and 33. The foul gas inlet 70 is coupled in fluid flowing relation relative to the third transversely disposed passageway 63. The foul gas inlet 70 is coupled with the source of foul gas 80 received from the refrigeration system 10.

Again, as earlier discussed, the source of foul gas 80 comes about as a result of the use of the refrigeration system 10, and where air and other atmospheric gases contaminate the refrigerant 20, thereby reducing its efficiency. The source of foul gas 80 includes non-condensed refrigerant and other remaining undesirable and non-condensable gases, such as air or other liquids and the like. It is the object of at least some embodiments 30 to purge these undesirable non-refrigerant and non-condensable gases or other liquids from the refrigeration system 10 in order to optimize the performance of the refrigeration system 10.

The purging apparatus 30 is coupled in fluid flowing relation relative to the refrigeration system 10; vessel 12; and an ambient environment 137 by means of a plurality of fluid conduits, which are generally indicated by the numeral 90 (See FIG. 2). These fluid conduits can be fabricated from carbon steel of traditional design as a non-limiting example and it should be appreciated that a wide variety of other materials could also be used. The plurality of fluid conduits includes first, second, third, fourth and fifth fluid conduits 91 through 95, respectively. The first fluid conduit 91 has a first end 101, which is coupled in fluid flowing relation relative to the condensed refrigerant outlet 71, and a second end 102, which is coupled in fluid delivering relation relative to the storage tank 12, as can be best seen by reference to FIGS. 1 and 2. The second fluid conduit 92 has a first end 103, which is coupled in fluid receiving relation relative to the non-condensable gas outlet 72, and a second end 104, which is coupled in fluid delivering relation relative an ambient environment but, which could include being passed through a filter or scrubber, similar to the illustrated water column 134. The water column 134 is illustrated as being coupled in fluid delivering relation relative to an ambient environment 137. The third fluid conduit 93 has a first end 105, which is coupled to the foul gas inlet 70, and a second end 106, which is coupled in fluid receiving relation relative to the refrigeration system 10, and which produces the source of foul gas 80. Additionally, the plurality of fluid conduits 90 includes a fourth fluid conduit 94, which extends between, and is coupled to the respective first and second fluid conduits 91 and 92, respectively. The fourth fluid conduit 94, has a first end 107, and an opposite second end 108. Additionally, the fifth fluid conduit 95 extends between, and is coupled in fluid flowing relation relative to the first and second fluid conduits 91 and 92 respectively. The fifth fluid conduit has a first end 109, and an opposite second end 110. Mounted on, and coupled in sensing relation relative to the first end 32 of the purging apparatus 30, is a temperature and pressure sensor 120 of conventional design. As seen in FIG. 2, the temperature and pressure sensor 120 is coupled in sensing relation relative to the first transversely disposed passageway 61, and which is defined by the main body 31 of the purging apparatus 30. Further, and located on the first fluid conduit 91, and oriented in a position between the first and second ends there of 101 and 102, respectively, is a remotely controllable solenoid valve 121 of traditional design. This, and the other solenoid valves as will be described are operable to control the flow of gases and fluids along the length of conduit on which they are positioned. The remotely controlled solenoid valve 121 is coupled with, and controlled by, a controller.

Additionally and mounted along the second fluid conduit 92, and located between the first and second ends thereof 103 and 104, respectively, are first and second remotely controllable solenoid valves 122 and 123, respectively. These first and second solenoid valves 122 and 123, respectively, are remotely controllable by the controller. Still further, and mounted downstream relative to the first and second solenoid valves 122 and 123, is a check valve 124 of conventional design. The check valve works in a conventional manner to allow the flow of fluid in only one direction. Additionally, and mounted downstream relative to the check valve 124, is a temperature sensor 125, which transmits an electrical signal relative to when a particular, predetermined temperature is sensed in the fluid or gas which is moving along the second fluid conduit 92. Mounted along the fourth fluid conduit 94, and located between the first and second ends thereof 107 and 108, is a mechanical level control valve 130 of traditional design, this structure maintains a set fluid level. For instance, in an exemplary embodiment, the level control valve may be a float valve that triggers, such as an Armstrong float valve as non-limiting examples. Additionally, and mounted along the fifth fluid conduit 95 is, again, another remotely controllable solenoid valve 131, which is, again, remotely controlled by the controller.

As best illustrated in FIG. 2, mounted along the third fluid conduit 93 is yet another remotely controllable solenoid valve 132, which is coupled with the controller. Downstream relative to the solenoid valve 132, the purging apparatus 30 further includes a reduced dimensioned orifice 133 of traditional design.

Positioned downstream of the temperature sensor 125, and along the second fluid conduit 92, in the illustrated embodiment is a water column 134 of traditional design. The water column is mounted in fluid receiving relation relative to the second fluid conduit 92. The water column permits the removal of any remaining non-condensed refrigerant gas that might have inadvertently escaped with the non-condensable gas delivered to the second fluid conduit 92. The water column 134 has a first end 135, which is coupled in fluid receiving relation relative to the second fluid conduit 92, and an opposite second end 136, which is coupled in fluid delivering relation to an ambient environment 137. A solenoid valve 138 is mounted downstream of the water column 134, and upstream of the ambient environment 137.

It will be appreciated that although the valves are described as solenoid valves, it should be appreciated that other automatic and/or controllable valves may also be employed in the various embodiments of the purging apparatus 30. For instance, pneumatic valves, manually controlled valves, wireless valves etc.

Figure 4:
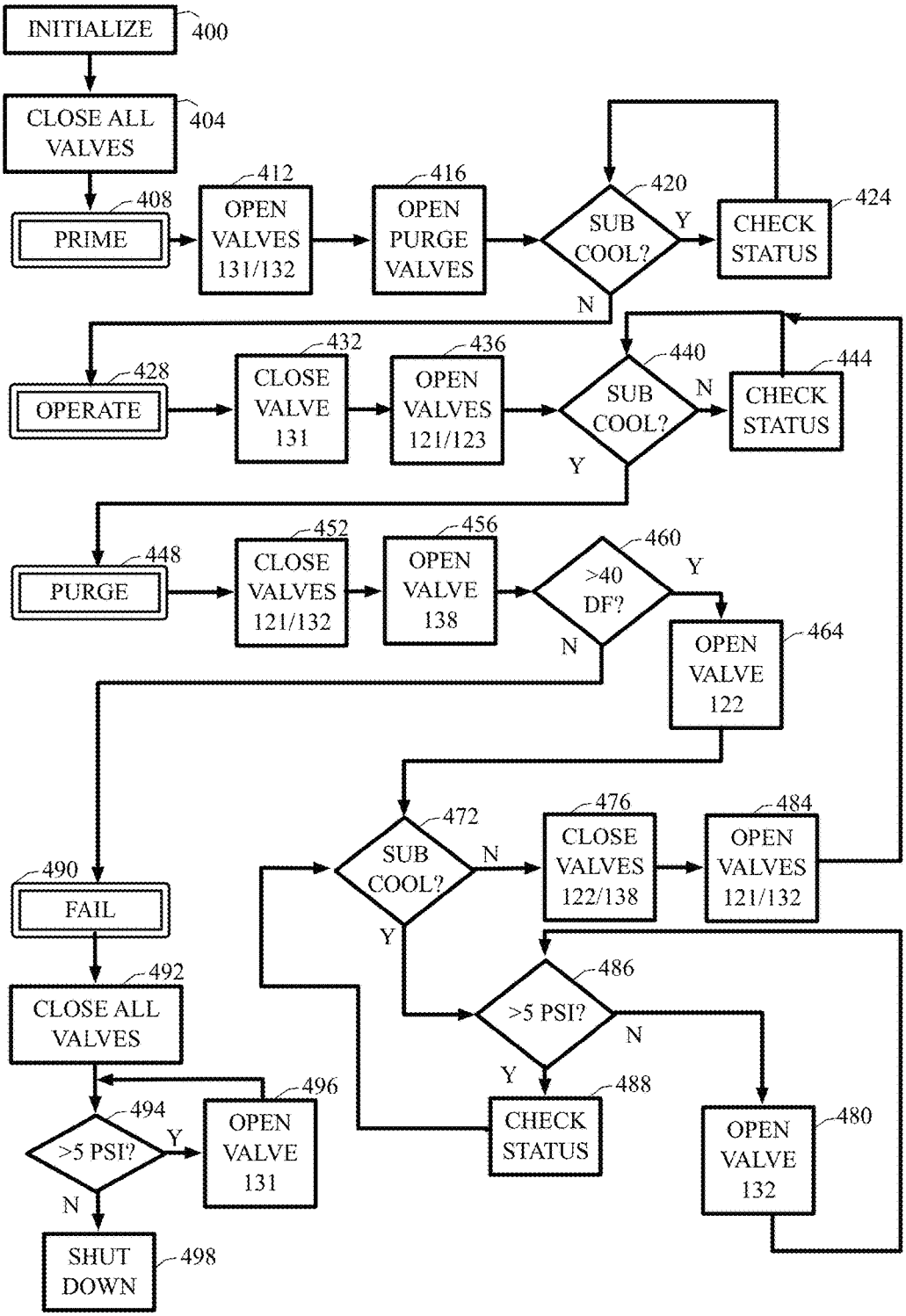
FIG. 4 is a schematic flow chart showing the operating sequence of an exemplary embodiment of the purging apparatus invention the various modes of operation.
Figure 6:
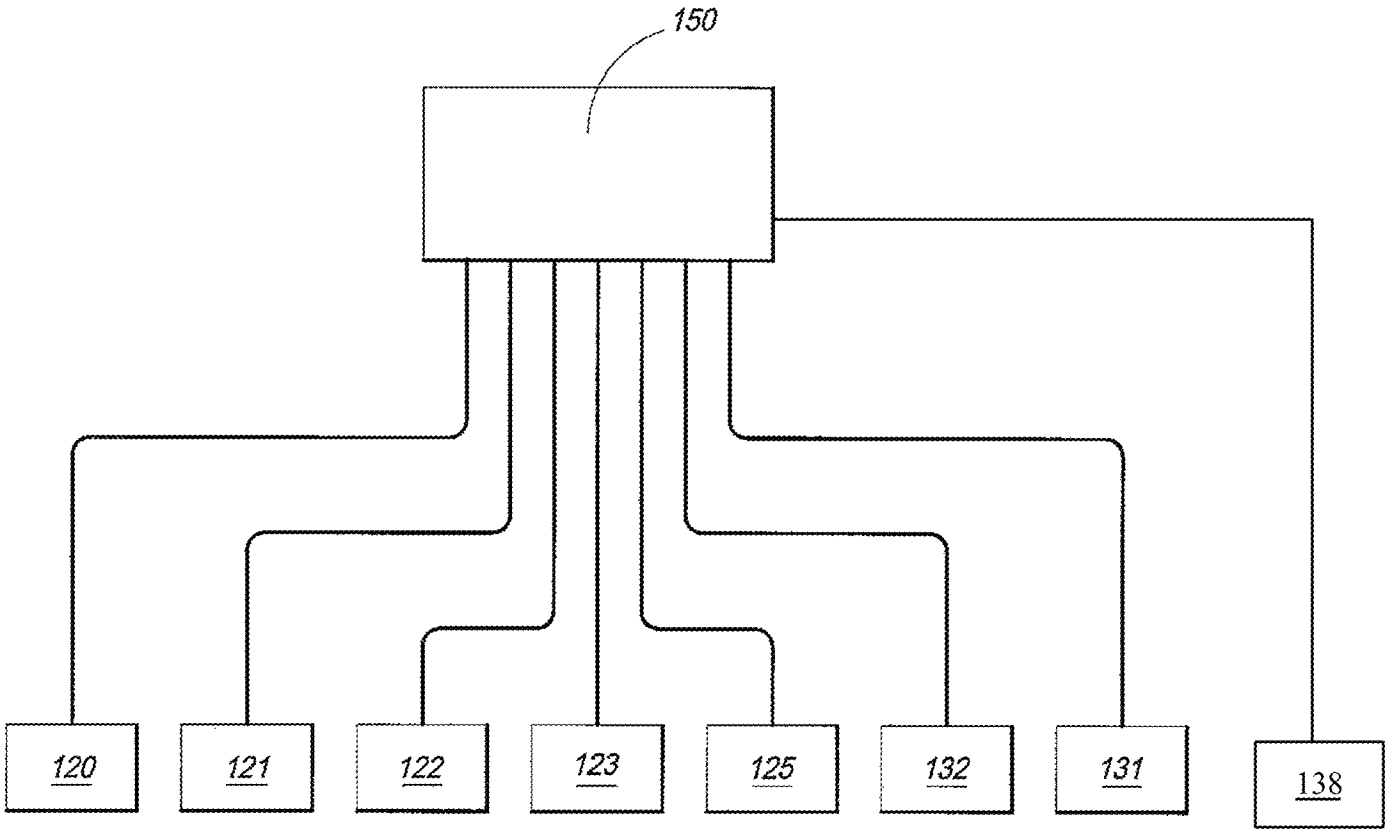
FIG. 6 is schematic depiction of a controller, which may be employed in various embodiments.

As best seen by reference to FIG. 6, the purging apparatus 30 has a controller 150 which is electrically coupled in either signal receiving or controlling relation relative to the temperature and pressure sensor 120; the fluid controlling solenoid valves 121, 122, 123, 131, 132 and 138; and the temperature sensor 125. The controller 150 is programmable so as to open and close the respective solenoid valves as previously described (FIG. 4) in a given sequence in order to effect a resulting purging cycle, to effectively remove non-condensable gases 152 from the source of foul gas 80, and which has entered the system by routine refrigeration operations. The operating sequence for performing a purge of the foul gas 80, and which is delivered to the purging apparatus 30 is illustrated in FIG. 4. It should be understood that this is only one of several possible sequences for the operation of the various solenoid valves. Still further, the controller 150 is coupled in signal receiving relation relative to the temperature and pressure sensor 120, and the temperature sensor 125 so as to utilize the sensor information to operate the above-identified respective remotely controllable solenoid valves in a fashion so as to prevent a malfunction of the purging apparatus 30, and which could result in an inadvertent release of non-condensed refrigerant gas to the ambient environment 137.

During the operation of the purging apparatus 30 within the refrigeration system 10, the main body 31 is passively cooled or maintained to keep the temperature at or below a threshold value at which non-condensed refrigerant gas 151 can be condensed. The condensation occurs within the plurality of vertically oriented internal passageways 51 within the purging apparatus 30. When the foul gas 80 is received within the main body 31, the subsequently condensed refrigerant 151 derived from the foul gas source 80, is gravitationally pulled to the first end 32 of the main body 31, and collects within the first transversely disposed passageway 61. This collected and condensed refrigerant then enters or passes into the first fluid conduit 91, where it moves between the first and second ends thereof 101 and 102, respectively, so that it may be deposited back within the vessel 12, and be mixed with the source of liquid refrigerant 20 that is contained therein. The foul gas 80 that has been exposed to the reduced temperature environment of the main body 31, will further include a non-condensable gas 152 which may include air or other gases, other than the refrigerant 151. Those non-condensable gases 152 will move to the second end 33 of the main body 31, and will then enter or pass into the second fluid conduit 92. This non-condensable gas will then move between the first and second ends of this conduit 103 and 104, respectively, and then enter or pass into the water column or other scrubber 134. Upon passing into the water column 134, the non-condensable gas 152 moves through the water contained within in the water column 134, and any remaining trace amounts of refrigerant gas will reactively combine with the water in the water column 134 so as to be removed from the resulting non-condensable gas 152. The non-condensable gas will then be released to the ambient environment at 137. It should be appreciated that the scrubber, such as the water column 134 may also include other inputs, such as a water source not illustrated in FIG. 2.

A temperature sensor 125 is located along the second fluid conduit 92. This temperature sensor 125 is operable to sense a predetermined low temperature of the non-condensable gas 12. If this low temperature is detected, the sensor is effective to send a signal to the controller 150 which is then operable to cause the first and/or second solenoid valves 122 and 123 to be closed thereby stopping the movement of fluid or gas along the conduit 92. It should be understood that a predetermined low temperature of the material triggering the temperature sensor 125 would be an indicator that a significant amount of non-condensed refrigerant gas continued to be mixed with the non-condensable gas 152, and therefore the purging of the refrigeration system 10 would be stopped until the problem had been identified and corrected.

The fifth fluid conduit 95 and the remotely controllable solenoid valve 131, which is positioned along this conduit, is provided so as to operate as a vent valve bypass utilized during a priming mode of the purging apparatus 30. This valve 131 may also be used in a failed or emergency evacuation of the purging device 30. Further, the float valve 130, which is positioned along the fourth fluid conduit 94, is effective to maintain a liquid level within the main body 31 at a specific level or a range of levels during normal operation. The remotely controllable solenoid valve 121 is utilized to control the delivery of the refrigerant that has been condensed with the main body 31 to the storage tank 12. Solenoid valve 132 is utilized to control the delivery of the foul gas 80, to the main body 31 through the foul gas inlet 70. Again, the controller 150 is operable to control the operation of the selected fluid flowing control solenoid valves in a sequence (FIG. 4) such that periodic purging or removal of non-condensable gases 152 can be accomplished in a manner whereby the non-condensable gases 152 can be safely released to the ambient environment 137 while removing substantially all the condensed refrigerant gases 151 from the earlier foul gas supply 80.

Operation

In its broadest aspect, the various embodiments of the purging apparatus operate to remove a non-condensable gas 152 from a refrigeration system 10. The purging apparatus 30 operates in conjunction with a storage tank or vessel 12 that houses a source of a refrigerant 20. The refrigerant 20 in the vessel is supplied by the refrigeration system 10 and operates within the refrigeration system 10. An exemplary embodiment of the vessel 12 is defined by a sidewall 13, having an exterior facing surface 15, and which is maintained at a low ambient temperature by the refrigerant 20 within the vessel 12. The purging apparatus 30 further includes a main body 31 that in general, operates like a condenser. The main body 31 is conductively connected to the exterior facing surface 15 of the vessel 12; however, in some embodiments the main body can be placed internal to the vessel as an after market add in or, it can be integrated into the vessel at time of manufacture. For the externally mounted embodiment, the main body 31 of the purging apparatus 30 is passively maintained at a low ambient temperature by the exterior facing surface 15 of the storage container 12. In essence, the vessel 12 operates like a heat sink to remove any heat from the main body 31 and lower the temperature past a threshold level. The low ambient temperature of the main body 31 is sufficient to effect the condensation of a non-condensed refrigerant gas, into a condensed refrigerant. In the arrangement as described above, the purging apparatus 30 further includes a first selectively controllable fluid flowing valve 121, which is positioned in downstream fluid receiving relation relative to the condensed refrigerant outlet 71, and in upstream fluid delivering relation relative to vessel 12. Additionally, the purging apparatus includes a second selectively controllable fluid flowing valve 122, which is positioned in downstream fluid receiving relation relative to the non-condensable gas outlet 72, and in upstream fluid delivering relation relatively ambient environment 137. Further, the purging apparatus 30 includes a third selectively controllable fluid flowing valve 132, which is located in upstream fluid delivering relation relative to the foul gas inlet 70.

The illustrated purging apparatus 30 further includes a water column 134, which is located in downstream fluid receiving relation relative to the second selectively controllable fluid flowing valve 122, and in upstream fluid delivering relation relative to the ambient environment 137. The non-condensable gas 152 passes through the water column 134 before the non-condensable gas is released to the ambient environment 137. Additionally, and as shown in the drawings, and as discussed earlier in this application, a sensor 120 is provided for detecting pressure and temperature and which is configured to generate a control signal. The sensor 120 is coupled in sensing relation relative to the first transversely disposed passageway 61, and which is defined by the main body of the condenser 30.

The illustrated purging apparatus 30 includes a controller 150, which is coupled in control signal receiving relation relative to the sensor 120, and is further disposed in controlling relation relative to each of the first, second and third selectively controllable fluid flowing valves 121, 122, and 132, so as to effect a periodic purging cycle, which removes the non-condensable gas 152 from the source of the foul gas 80, and further facilitates the delivery of the condensed refrigerant 151, which is derived from the source of the foul gas 80, to the storage tank 12; and a release of the resulting non-condensed gas 151 to the ambient environment 137. The purging apparatus 30 further includes a temperature sensor 125, which is located in temperature sensing relation relative to the non-condensable gas 152, and which is subsequently passed through the water column 134. The temperature sensor 125 senses the temperature of the non-condensable gas flow 152 at a location upstream of both of the water column 134 and where the non-condensable gas 152 is released to the ambient environment 157. The temperature sensor 125 generates a signal that is transmitted to the controller 150, when a predetermined low temperature of non-condensable gas 152, as sensed by the temperature sensor 125 is detected. This temperature signal is effective in causing the controller 150 to operate the second selectively controllable fluid flowing valve 122, in a manner that impedes the release of the non-condensable gas to the ambient environment 137. In the arrangement as shown in the drawings, the purging apparatus 30, and more specifically the main body 31 of the condenser 30, is fabricated from aluminum, and the passive cooling of the main body of the condenser is effective to cause the non-condensed refrigerant within the source of foul gas 80 to condense and be collected for subsequent return to the refrigeration system 10 as earlier described.

Therefore, it will be seen that various embodiments of a purging apparatus may provide many advantages over the purging arrangements employed heretofore. More specifically, the purging apparatus 30 is passive, and is cooled by an adjacent storage container for the refrigerant 151. The level of complexity of the purging apparatus is reduced so as to provide a purging apparatus that is cost-effective to install, and maintain, and which is further fully effective in removing foul gases from a resulting refrigerant stream in a manner not possible heretofore.

FIG. 4 is a schematic flow chart showing the operating sequence of an exemplary embodiment of the purging apparatus invention and the various modes of operation. The exemplary operation 400 commences with an initialization step in which the controller may set variables and registers, clear stacks, etc., and the purging apparatus 30 can be set to a known state, such as closing all of the valves 404. The purging apparatus 30 then enters into the PRIME mode of operation 408 in which the main body 31 receives non-condensed gases 80 from one or more sources. For instance, in a typical refrigeration system, multiple condensers, each having an outlet sharing a common conduit may feed the purging apparatus 30. In addition, multiple purging apparatuses may be utilized in any particular refrigeration system. Thus, in the PRIME mode, valves 131 and 132 are opened 412 and then the first purge valve in sequence from the condensers that feed into the purging apparatus 30 is opened. It should be appreciated that within the context of this description, an open valve means that the passage through the valve is created thus allowing matter to pass through the valve to the other side. Likewise, a closed valve includes an obstruction that prevents the passage of matter through the valve. As the non-condensed gas enters into the cavity 50 of the main body 31 through the open valve 132, the cavity 50 of the main body begins to receive foul gas from the refrigeration system. During the PRIME mode of operation, the temperature/pressure sensor 120 continuously checks status thought the loop 420-424 for sub cool condition. This process continues until it is determined that a subcool condition 420 does not exist. At this point the OPERATE mode is entered. It will be appreciated that the term subcool or subcooling refers to a liquid existing at a temperature below its normal saturation temperature and is well defined as a term in industry.

Upon entering the OPERATE mode 428, valve 131 is closed 432 and valves 121 and 123 are opened 426. In this condition, valves 132, 121 and 123 are opened while valves 122, 138 and 131 are closed. This allows non-condensed gas to enter into the cavity 50 of the main body 31 and the condensed refrigerant falls to the bottom of the cavity 50 while the non-condensed gas rises to the top of the cavity 50. As the condensed refrigerant level rises to a predetermined level, the float valve 130 opens and allows the condensed refrigerant to drain from the cavity 50, through valve 121 and into the vessel 12. During the OPERATE mode 428, the pressure/temperature sensor 120 is monitored to detect a sub cool condition. If a sub cool condition is not met, the status check 444 returns to action 440 to continue the check until a sub cool condition is detected. The sub cool condition occurs in the OPERATE mode 428 when the amount of non-condensed gas and condensed refrigerant exceed a particular level. At this point the PURGE mode 448 is invoked to bleed off the non-condensed gas from the cavity 50 of the main body 31.

In the PURGE mode 448, valves 121 and 132 are closed 452 and valve 138 is opened 456. The closing of valves 132 and 121 prevent further non-condensed matter from entering into the cavity 50 of the main body 31 and also prevents the condensed refrigerant from exiting the cavity 50. Opening of valve 138 allows water to flow into the water column 134 in preparation for scrubbing of the non-condensed gas. The temperature of the non-condensed gas is checked by reading the temperature sensor 125. If the temperature of the non-condensed gas falls below a setpoint, such as 40 degrees F. 460 as a non-limiting example, the operation goes to the FAIL state 490 as described in further detail below. If the temperature is acceptable, valve 122 is opened and the non-condensed gas exits the cavity 50 of the main body, travels through conduit 92, through valves 122, 123 and one-way valve 124, then through connection 135 into the water column 134. In addition, the purge valves from one or more condensers may also be opened to maintain positive pressure within cavity 50. Finally, the scrubbed gas is expelled into the ambient air 137 through opening 136. During this process, the pressure/temperature sensor 120 is checked to see if a sub cool condition exists 472 within the cavity 50. If a sub cool condition does not exists 472, then valves 122 and 138 are closed 476, valves 121 and 132 are opened 484 and processing continues with action 440 to again check for a sub cool condition as the purging apparatus 30 enters the OPERATE mode 428.

However, if a sub cool condition exists 472 during the PURGE mode 448, the process continues by checking to see if the pressure within the cavity 50 is maintained at a set pressure, such as >5 PSI as a non-limiting example. The system operates to to maintain a positive pressure so as to facilitate the discharge of non-condensable gases. The pressure within the body decreases as the unit is discharging. If the pressure is less than the set pressure, the process operates 480 to open valve 132 until the desired pressure is achieved. Once the desired pressure is achieved, processing returns to action 472 to check if a sub cool condition exists.

If while the purging apparatus is in the PURGE mode 448 it is determined that the temperature of the purged non-condensed gas is less than a threshold temperature, such as 40° F. as a non-limiting example, then a FAIL mode 490 of operation is entered.

In the FAIL mode, the purging apparatus 30 operates to close all of the valves 492 and then bleeds off the cavity 50 until the pressure within the cavity is less than a threshold level 494, such as 5 PSI as a non-limiting example. If the pressure is greater than the threshold level, valve 131 is opened 496 to allow the non-condensed gas to exit the cavity 50 and pass through conduit 92, conduit 95 and conduit 91 into the vessel 12. Once the pressure within the cavity 50 is below the threshold level, the purging apparatus 30 is shut down 498.

Figure 7:
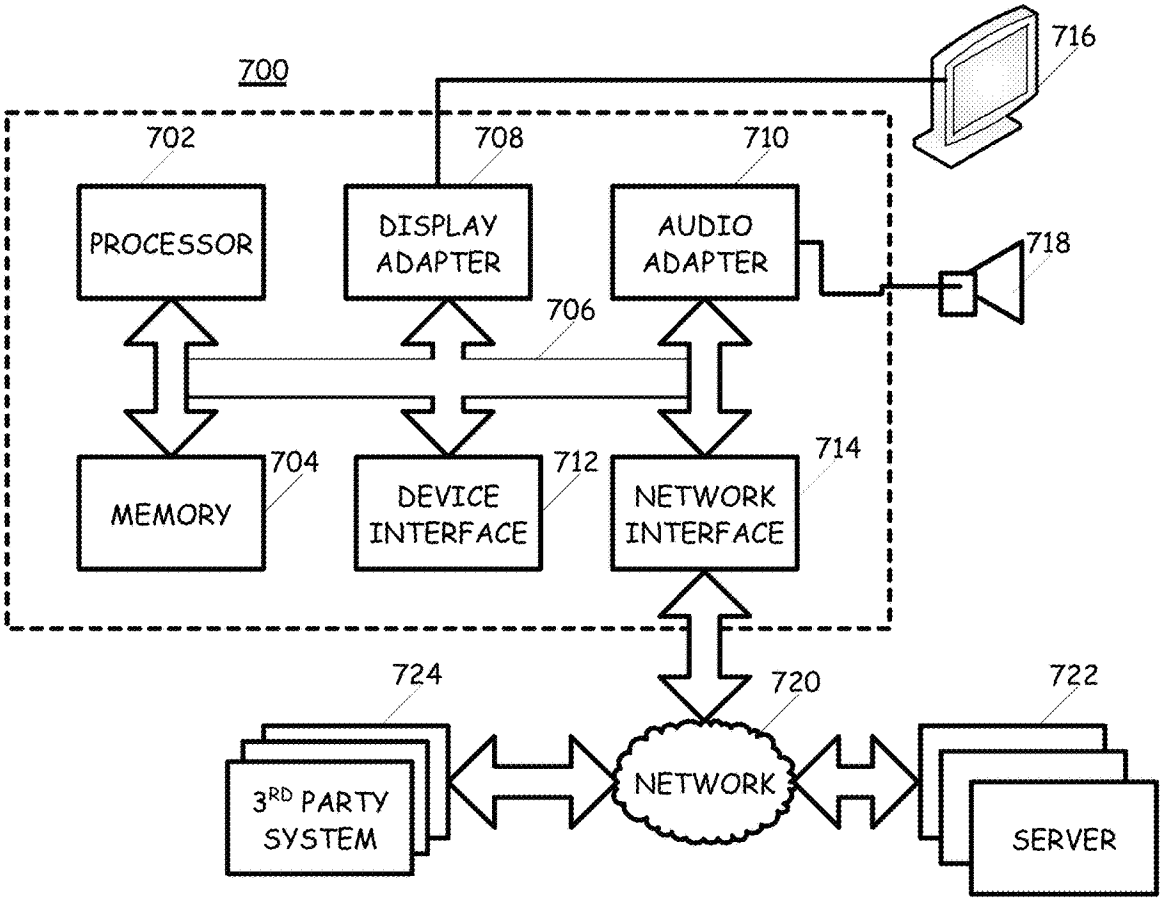
FIG. 7 is a block diagram of a computing platform that may serve as an operational environment or platform for various embodiments and functional aspects of the embodiments of the purging apparatus.

FIG. 7 is a block diagram of a computing platform that may serve as an operational environment or platform for various embodiments and functional aspects of the embodiments of the purging apparatus. For instance, FIG. 7 may represent an embodiment of the controller to monitor and control the valves and sensors. It will be appreciated that not all of the components illustrated in FIG. 7 are required in all embodiments or implementations of the controller or other element but, each of the components are presented and described in conjunction with FIG. 7 to provide a complete and overall understanding of the components. In addition, it will be appreciated that the tracker may be implemented in systems and/or environments that may include other components and functionality and as such, the illustrated configuration is simply a non-limiting example.

The exemplary platform 700 is illustrated as including a processor 702 and a memory element 704. In some embodiments the processor 702 and the memory element 704 may be communicatively coupled over a bus or similar interface 706. In other embodiments the processor 702 and the memory element 704 may be fully or partially integrated with each other. The processor 702 can be a variety of processor types including microprocessors, micro-controllers, programmable arrays, custom IC's etc. and may also include single or multiple processors with or without accelerators or the like. The memory element of 704 may include a variety of structures, including but not limited to RAM, ROM, magnetic media, optical media, bubble memory, FLASH memory, EPROM, EEPROM, etc. In addition, rather than being internal to the platform 700, the memory element 704 may be external to the platform 700 and accessed through a device interface 712 or network interface 714. The processor 702, or other components may also provide sub-components or functionality such as a real-time clock, analog to digital converter, digital to analog converter, sensors, etc. The processor 702 also interfaces to a variety of elements including a control/device interface 712, a display adapter 708, audio adapter 710 and a network/device interface 714. The control/device interface 112 provides an interface to external devices, systems, equipment, sensor, actuators or the like. As non-limiting examples, the control/device interface 712 can be used to interface with devices or systems such as a keyboard, a mouse, a pin pad, and audio activate device, a PS3 or other game controller, as well as a variety of the many other available input and output devices or, another computer or processing device. The display adapter 708 can be used to drive a variety of visually oriented alert elements 716, such as display devices including an LED display, LCD display, one or more LEDs or other display devices. The audio adapter 710 interfaces to and drives a variety of audible or other alert elements 718, such as a speaker, a speaker system, buzzer, bell, vibrator, etc. The network/device interface 714 can also be used to interface the computing platform 700 to other devices or systems through a network 720. The network may be a local network, a wide area network, wireless network (WIFI, Bluetooth, cellular, 3G, etc.), a global network such as the Internet, or any of a variety of other configurations including hybrids, etc. The network/device interface 714 may be a wired interface or a wireless interface. The computing platform 700 is shown as interfacing to a server 722 and a third party system 724 through the network 720.

It is to be understood, that the invention is not limited to the specific features, functions and aspects shown and described in the exemplary embodiments and that not all of the features, functions and/or aspects are required in all of the embodiments. Further, features, functions and aspects described in one embodiment may be incorporated into other embodiments and, features, functions and aspects presented in some embodiments may be removed to create yet other embodiments. The invention is, therefore, claimed in any of its forms and modifications within the proper scope of the appended claims appropriately interpreted in accordance with the Doctrine of Equivalents.

We claim:

1. A purging apparatus for removing a non-condensable gas from a refrigeration system by receiving a foul gas from the refrigeration system, the foul gas containing non-condensed refrigerant and non-condensable gas, the apparatus comprising:

a main body that is adjacent to and coupled to a surface of a low temperature vessel of the refrigeration system such that refrigerant within the vessel operates to cool the main body; and a plurality of internal passageways within the main body to provide a condensing operation for gaseous contents within the plurality of internal passageways;

a foul gas inlet for allowing foul gas to enter the plurality of internal passageways;

a condensed refrigerant outlet that is fluidly coupled to the low temperature vessel; and a non-condensable gas outlet, wherein the foul gas within the plurality of internal passageways is exposed to low ambient temperature by means of the coupling of the main body to the low temperature vessel, thereby facilitating a condensation of the previously non-condensed refrigerant from a source of foul gas, wherein the source of foul gas is at least one condenser of the refrigeration system, and wherein the condensed refrigerant passes out of the main body by way of the condensed refrigerant outlet, and is returned to the vessel, and the non-condensable gas exits the main body by way of the non-condensable gas outlet and is released to an ambient environment.

2. The purging apparatus of claim 1, wherein the main body is coupled to the surface of the low temperature vessel by being thermally coupled to the side of the low temperature vessel such that the low temperature vessel, which is cooled by the refrigerant within the vessel operates as a thermal heat sink.

3. The purging apparatus of claim 1, and wherein the main body of the purging apparatus has at least one surface which conformably mates with, and is disposed to transferring heat through an exterior facing surface of the low temperature vessel to the refrigerant within so as to facilitate a reduction in the temperature of the main body of the purging apparatus.

4. The purging apparatus of claim 1, wherein the plurality of internal passageways within the main body are vertically oriented internal passageways each having opposite first and second ends, and an intermediate portion, and wherein the respective first and second ends, and intermediate portions of each of the vertically oriented internal passageways are each coupled in fluid flowing relation relative to each other.

5. The purging apparatus of claim 4, wherein the main body defines a first transversely disposed passageway which couples the first end of each of the vertically oriented internal passageway in fluid flowing relation; a second transversely disposed passageway which couples the second end of each of the vertically oriented internal passageways in fluid flowing relation; and a third, transversely disposed passageway which couples the intermediate portion of each of the vertically oriented passageways in fluid flowing relation relative to each other.

6. The purging apparatus of claim 5, wherein the condensed refrigerant outlet is coupled in fluid receiving relation relative to the first, transversely disposed passageway; the non-condensable gas outlet is coupled in fluid receiving relation relative to the second, transversely disposed passageway; and the foul gas inlet is coupled in fluid flowing relation relative to the third transversely disposed passageway.

7. A purging apparatus for removing a non-condensable gas from a refrigeration system by receiving a foul gas from the refrigeration system, the foul gas containing non-condensed refrigerant and non-condensable gas, the apparatus comprising:

a main body that is associated with a vessel of the refrigeration system such that refrigerant within the vessel operates to cool the temperature of the main body; and a plurality of internal passageways within the main body to provide a condensing operation for gaseous contents within the plurality of internal passageways;

a foul gas inlet for allowing foul gas to enter the plurality of internal passageways;

a condensed refrigerant outlet; and a non-condensable gas outlet, wherein the foul gas within the plurality of internal passageways is exposed to lower ambient temperature by means of the association of the main body to the low temperature vessel, thereby facilitating a condensation of the previously non-condensed refrigerant from a source of foul gas and wherein the condensed refrigerant passes out of the main body by way of the condensed refrigerant outlet, and is returned to the vessel, and the non-condensable gas exits the main body by way of the non-condensable gas outlet and is released to an ambient environment, wherein the plurality of internal passageways within the main body are vertically oriented internal passageways each having opposite first and second ends, and an intermediate portion, and wherein the respective first and second ends, and intermediate portions of each of the vertically oriented internal passageways are each coupled in fluid flowing relation relative to each other, and wherein the main body of the purging apparatus defines a first transversely disposed passageway which couples the first end of each of the vertically oriented internal passageway in fluid flowing relation; a second transversely disposed passageway which couples the second end of each of the vertically oriented internal passageways in fluid flowing relation; and a third, transversely disposed passageway which couples the intermediate portion of each of the vertically oriented passageways in fluid flowing relation relative to each other, and wherein the condensed refrigerant outlet is coupled in fluid receiving relation relative to the first, transversely disposed passageway; the non-condensable gas outlet is coupled in fluid receiving relation relative to the second, transversely disposed passageway; and the foul gas inlet is coupled in fluid flowing relation relative to the third transversely disposed passageway;

a first, selectively controllable fluid flowing valve which is positioned in downstream fluid receiving relation relative to the condensed refrigerant outlet, and in upstream fluid delivering relation relative to the vessel;

a second, selectively controllable fluid flowing valve which is positioned in downstream fluid receiving relation relative to the non-condensable gas outlet, and in upstream fluid delivering relation relative to the ambient environment; and a third, selectively controllable fluid flowing valve which is located in upstream fluid delivering relation relative to the foul gas inlet.

8. The purging apparatus of claim 7, further comprising:

a sensor configured to detect pressure and temperature, and which is configured to generate a control signal, and which is further coupled in sensing relation relative to the first transversely disposed passageway and which is defined by the main body.

9. The purging apparatus of claim 8, further comprising:

a controller which is coupled in control signal receiving relation relative to the sensor, and is further disposed in controlling relation relative to each of the first, second and third selectively controllable fluid flowing valves so as to effect a periodic purging cycle which removes the non-condensable gas from the foul gas, and further facilitates the delivery of the condensed refrigerant, which is derived from the foul gas, to the storage tank, and a release of the resulting non-condensed gas to the ambient environment.

10. The purging apparatus of claim 7, further comprising:

a fourth selectively controllable fluid flowing valve which is located in downstream, fluid flowing relation relative to the second, selectively controllable fluid flowing valve, and in upstream fluid delivering relation relative to the ambient environment, and wherein the non-condensable gas passes through, and said fourth selectively controllable fluid flowing valve can be closed in the event of failure of the second valve.

11. The purging apparatus of claim 10, further comprising:

a temperature sensor located in temperature sensing relation relative to the non-condensable gas which has passed through the second selectively controllable valve, and wherein the temperature sensor senses the temperature of the non-condensable gas at a location which is downstream of the fourth selectively controllable valve, and upstream of a location where the non-condensable gas is released to the ambient environment; and wherein the temperature sensor generates a signal which is transmitted to a controller, and wherein a predetermined low temperature of the non-condensable gas, as sensed by the temperature sensor, is effective in causing the controller to operate the fourth, selectively controllable fluid flowing valve in a manner which impedes the release of excessive refrigerant to the ambient environment.

12. The purging apparatus of claim 11, wherein the main body is fabricated from aluminum, and wherein a dielectric fluid coupler is mounted to each of the foul gas inlet, condensed refrigerant outlet and the non-condensable gas outlet, and wherein the respective dielectric fluid couplers are matingly coupled, in fluid flowing relation relative to individual steel conduits.

* * * * *